United States Patent [19]

Davis

[11] 4,067,278

[45] Jan. 10, 1978

[54] METHOD OF DECORATING A FABRIC AND THE DECORATED FABRIC

[76] Inventor: Eugene B. Davis, 1100 E. 10th St., Los Angeles, Calif. 90021

[21] Appl. No.: 743,486

[22] Filed: Nov. 19, 1976

[51] Int. Cl.[2] ..... D05B 1/00

[52] U.S. Cl. ..... 112/262; 112/429

[58] Field of Search ..... 112/429, 410, 430, 439, 112/405, 265, 262

[56] References Cited

U.S. PATENT DOCUMENTS

| | | | |
|---|---|---|---|
| 1,446,808 | 2/1923 | Moore | 112/429 |
| 2,013,148 | 9/1935 | Gottlieb | 112/9 X |
| 2,027,472 | 1/1936 | Colbert | 112/9 |
| 2,311,575 | 2/1943 | Robinson | 112/9 X |
| 3,024,518 | 3/1962 | Newton | 112/410 X |

*Primary Examiner*—Alfred R. Guest

*Attorney, Agent, or Firm*—Blair & Brown

[57] ABSTRACT

A method of decorating a fabric in which an elongate strip of fabric is sewed to a base fabric along a line spaced inwardly from the edge of the strip of fabric. The base fabric with strips sewed thereto is then washed in a washing machine so as to cause the edges of the strips of fabric outside of the line of stitching to fray and to thus take on a decorative appearance. The invention also includes the fabric produced by this method with the strips of material being arranged in any desired decorative pattern on the base material.

2 Claims, 14 Drawing Figures

METHOD OF DECORATING A FABRIC AND THE DECORATED FABRIC

BACKGROUND OF THE INVENTION

FIELD OF THE INVENTION

The present invention relates to a method of producing a decorative fabric and the decorative fabric so produced.

SUMMARY OF THE INVENTION

In the method of producing a decorative fabric a strip of fabric material is secured to a base material by a line of stitching adjacent to at least one edge of the strip of material but spaced inwardly therefrom. The base fabric with the strip of decorative material sewn thereto is then washed in a washing machine to cause the edge of the strip of material outside of the line of stitching to become frayed thus producing a decorative appearance. The fabric produced by this method may have the strips of material in any desired form or pattern to produce desired effects.

The primary object of the invention is to provide a method of producing a decorative fabric with frayed edges on the decorative material.

Other objects and advantages will become apparent in the following specification when considered in light of the attached drawings.

DESCRIPTION OF THE PREFERRED EMBODIMENT

Figure 1:
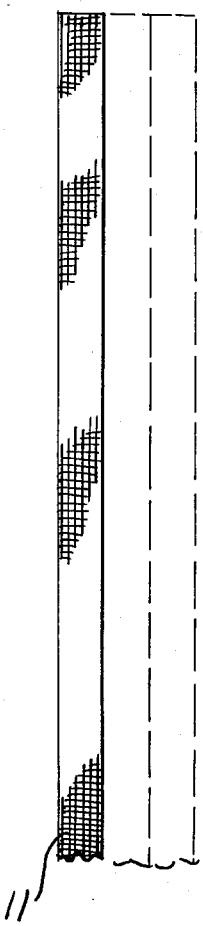
FIG. 1 is a plan view of a strip of fabric for application to a base fabric.
Figure 2:
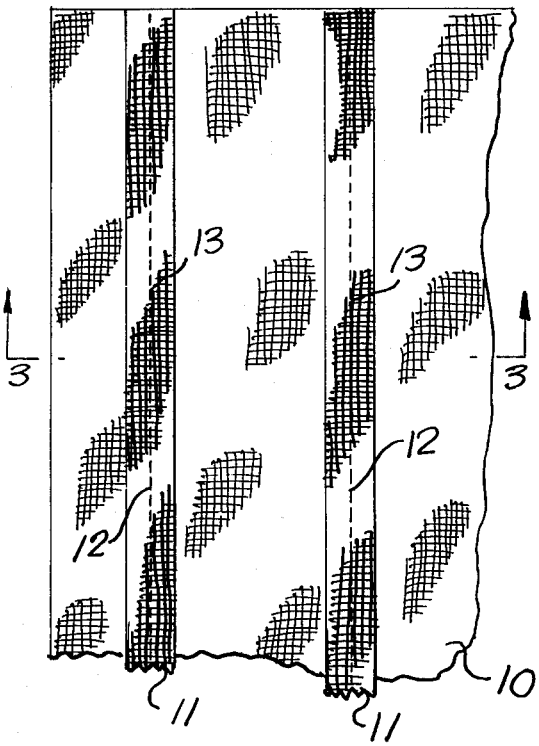
FIG. 2 is a plan view of a base fabric with the strips of fabric from FIG. 1 sewn thereto.
Figure 4:
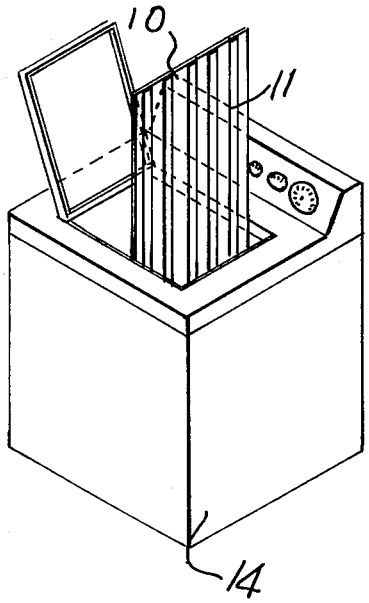
FIG. 4 is a perspective view of the washing step of the method.
Figure 3:
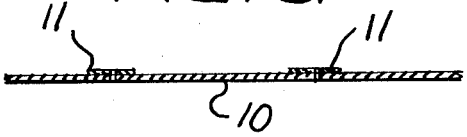
FIG. 3 is a transverse sectional view taken along the line 3—3 of FIG. 2 looking in the direction of the arrows.
Figure 5:
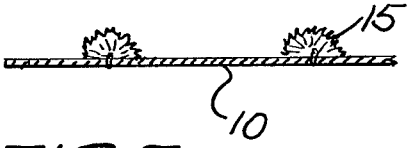
FIG. 5 is a view similar to FIG. 3 illustrating the frayed appearance of the strip after washing.
Figure 6:
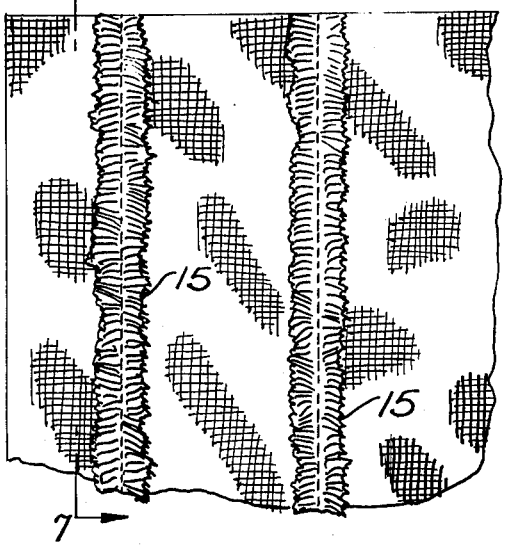
FIG. 6 is a view similar to FIG. 2 of the base fabric with the frayed strip illustrated thereon.
Figure 7:
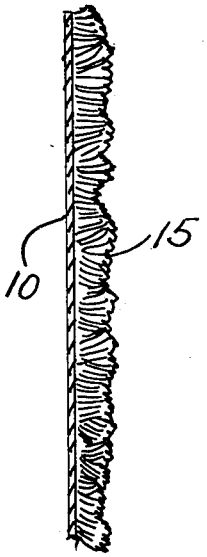
FIG. 7 is a longitudinal sectional view taken along the lines 7—7 of FIG. 6 looking in the direction of the arrows.

In the practice of the method of the present invention a base fabric 10 has a strip of fabric 11 sewn thereto by a line of stitching 12 with the stitching 12 spaced inwardly from but closely adjacent to the edge 13 of the strip of material 11. The base fabric 10 with strips 11 applied thereto is then washed in a washing machine 14 for a time sufficient to fray the edges 13 of the strip 11 until the frayed edges bulk outwardly at 15 as seen in FIGS. 5, 6 and 7. The line of stitching 12 while shown as a single line may actually be several rows of parallel stitching or rows of stitching parallel to the adjacent side edge of the strip 11 should the strip 11 have a form other than a straight line.

Figure 8:
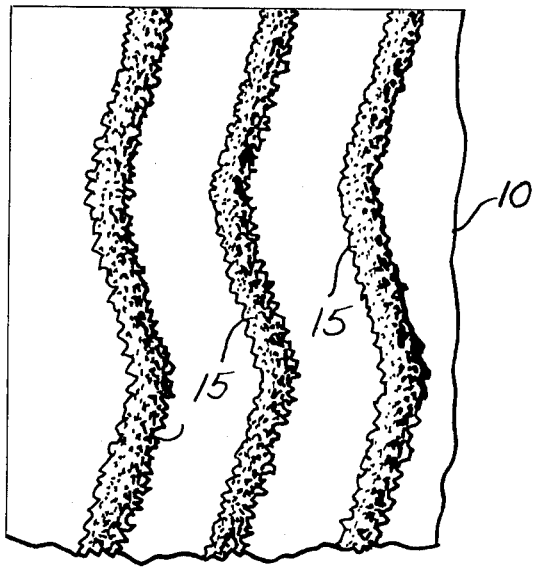
FIGS. 8 through 13 are plan views of a number of patterns of decoration possible with the present invention.

FIG. 8 illustrates the base fabric 10 having the bulked out portions 15 arranged in zigzag rows.

Figure 9:
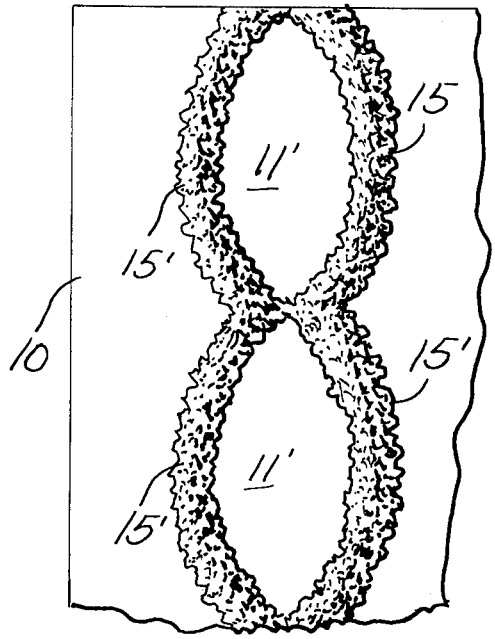

In FIG. 9 the base fabric 10 has oval strips 11' with their side edges bulked out at 15' to produce a rather unusual pattern.

Figure 10:
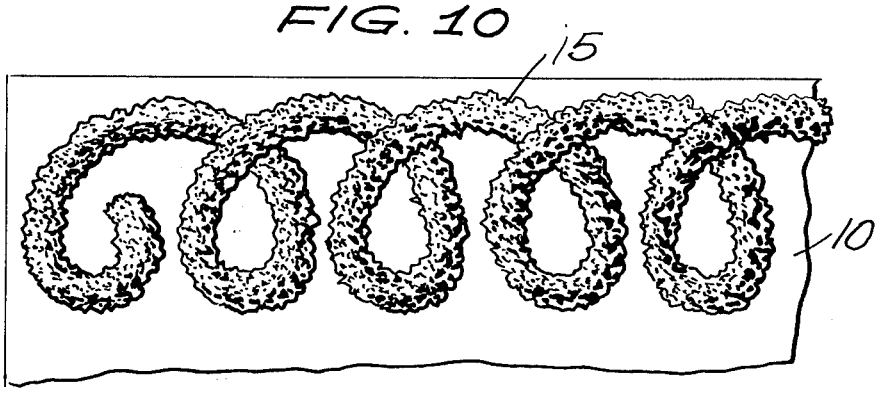

In FIG. 10 the base fabric has the bulked out strip 15 applied in a plurality of loops.

Figure 11:
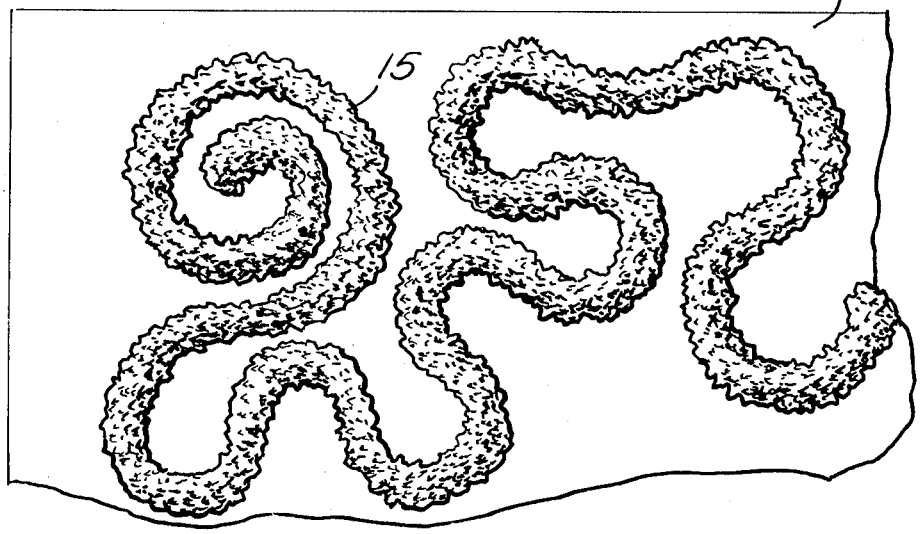

In FIG. 11 the base fabric 10 has the bulked out strip 15 extending in a random curved pattern.

Figure 12:
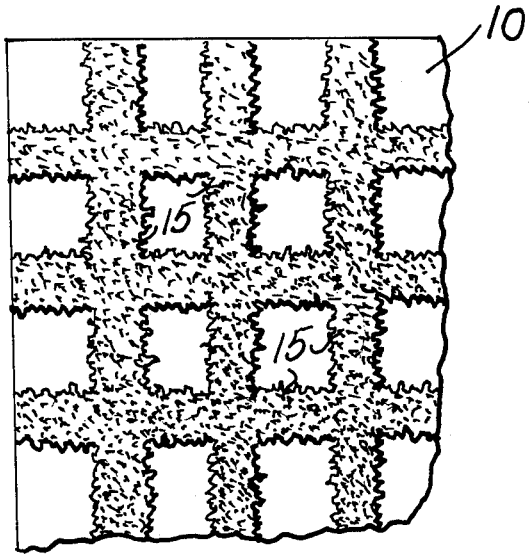

In FIG. 12 the base fabric 10 has the bulked out strips 15 applied in a square pattern.

Figure 13:
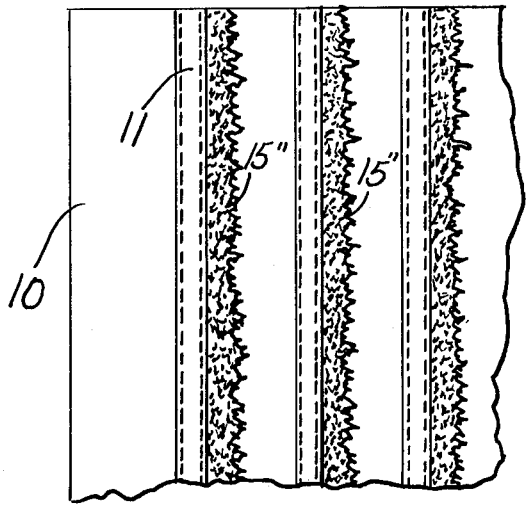

In FIG. 13 the base fabric 10 has the strips 11 secured thereto so that only one side edge can bulk out at 15''.

Figure 14:
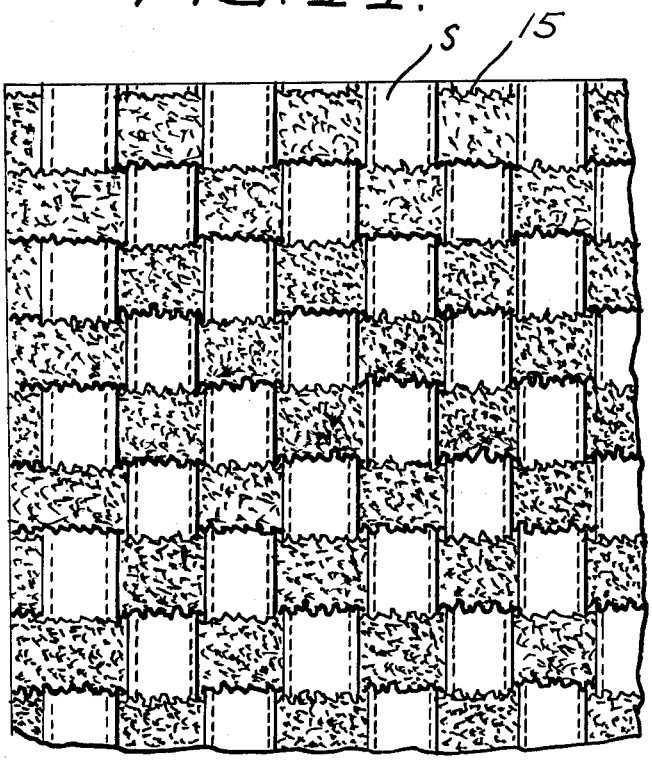
FIG. 14 is a plan view of a pattern in which the strips are sewn to strips of the base material and interwoven into a decorative fabric.

In FIG. 14 the strips of bulked out material 15 have been formed by securing strips 11 to a narrow hemmed strip of base material 10 and then weaving the strips 10 with additional strips S following which the material is washed to produce the blocked out portions 15.

The decorated fabric produced with the above described method may be used for apparel and any other place where decorative fabric is desired.

Having thus described the preferred embodiment of the invention, it should be understood that numerous structural modifications and adaptations of the basic invention may be resorted to without departing from the spirit of the invention.

What is claimed is:

1. A method of producing a decorative fabric comprising the steps of providing a base fabric, cutting an elongate strip of fabric for application to the base fabric, securing the elongate strip of fabric to the base fabric with a line of stitching closely adjacent to one side edge of the strip of fabric but spaced inwardly therefrom, and washing the fabric in a washing machine to fray the edges of the strip outside of the line of stitching.

2. A method as claimed in claim 1 including the step of applying a plurality of lines of stitching to secure the strip to the base fabric.

* * * * *